United States Patent [19]

Alcala

[11] Patent Number: 4,979,744

[45] Date of Patent: Dec. 25, 1990

[54] TOE-HEEL WEIGHTED GOLF PUTTER

[76] Inventor: Felix E. Alcala, 25227 N. Ranch Gate Rd., Scottsdale, Ariz. 85255

[21] Appl. No.: 359,214

[22] Filed: May 31, 1989

[51] Int. Cl.[5] ..... A63B 53/04

[52] U.S. Cl. ..... 273/169; 273/173; 273/78; 273/DIG. 23

[58] Field of Search ..... 273/167–175, 273/80 R, DIG. 23, 77 R, 80.2, 164, 77 A, 80 C; D21/217–219

[56] References Cited

U.S. PATENT DOCUMENTS

| | | | |
|---|---|---|---|
| D. 247,381 | 2/1978 | Adkins | D21/219 |
| 1,517,476 | 12/1924 | Tyler | 273/80 A X |
| 2,325,525 | 7/1943 | Lukenbill | 273/79 |
| 2,530,446 | 11/1950 | Beardsley | 273/168 X |
| 3,042,405 | 7/1962 | Solheim | 273/168 |
| 3,061,310 | 10/1962 | Giza | 273/78 |
| 3,387,844 | 6/1968 | Shippee | 273/77 R |
| 3,516,674 | 6/1970 | Scarborough | 273/171 |
| 3,841,640 | 10/1974 | Gaulocher | 273/164 |
| 3,888,492 | 6/1975 | Cabot | 273/186 A |
| 3,923,308 | 12/1975 | Mills | 273/183 D |
| 4,113,249 | 9/1978 | Beery | 273/78 |
| 4,121,832 | 10/1978 | Ebbing | 273/171 |
| 4,123,056 | 10/1978 | Nakamatsu | 273/78 |
| 4,174,108 | 11/1979 | Reinholz | 273/79 |
| 4,508,350 | 4/1985 | Duclos | 273/183 D |
| 4,529,202 | 7/1985 | Jacobson | 273/175 |
| 4,848,747 | 7/1989 | Fujimura et al. | 273/77 A |

*Primary Examiner*—Edward M. Coven
*Assistant Examiner*—Sebastiano Passaniti
*Attorney, Agent, or Firm*—Poms, Smith, Lande & Rose

[57] ABSTRACT

A golf putter including a lightweight frame made of composite material in combination with metal toe and heel weights which distribute substantially all of the club weight at the toe and heel. The toe and heel weights also form exterior surfaces for the putter and have variable thicknesses to provide fore and aft clubhead balancing. Other features with respect to the lightweight frame structure are disclosed.

9 Claims, 2 Drawing Sheets

8
9
10
12
14
16
18
20
22
24
26
28
30
32
34
36
38
40
42
44
46

TOE-HEEL WEIGHTED GOLF PUTTER

BACKGROUND OF THE INVENTION

1. Field of the Invention

The present invention relates generally to golf putters. More particularly, the present invention relates to a lightweight golf putter head utilizing a main frame composite structure having weighted toe and heel sections.

2. Description of Related Art

The golf putter is among the most important of the golf clubs. The putter is used in and around the green where extremely accurate ball contact is required in order to direct the ball into the cup. The structure and design of putters is substantially different from other golf clubs for a number of reasons. Most importantly, the stroke used by golfer when putting is much slower and smaller than the golf stroke used for distance clubs and irons. As a result, the design and appearance of the putter is extremely important to the golfer since it is visible during the entire putting stroke. Accordingly, club designers have continually attempted to provide putter designs and configurations which provide visual cues that enhance the golfers ability to accurately putt the ball. As a result, numerous putter designs have been developed over the years.

The weighting or balance of the putter is also an important consideration in designing a suitable club. Many different weight distribution configurations have been tried in the past. In general, weight distributions between the heel and toe portion of the putter as well as fore and aft weight distribution have been matched to various putter design configurations. A sampling of such golf putter configurations are shown in U.S. Pat. Nos. 3,061,310; 3,841,640; 3,888,492; 3,923,308; 4,113,249 and 4,123,056. The putter configurations and designs set forth in the preceding U.S. Patents are exemplary of the wide variety of putter designs and configurations available.

Although many different putter designs are presently available, there still is a continuing need to provide new putter designs and configurations which promote improved putting. The "feel" and "look" of a putter is an extremely important consideration for a golfer when it comes time to accurately direct a golf ball toward a cup which may be as much as thirty or forty feet away. Due to the wide range in golfer abilities and individual tastes, no single putter design or configuration has been able to satisfy every golfer's needs. However, there is a continuing need for putters which include various design characteristics which promote and improve a golfer's game on and around the green.

SUMMARY OF THE INVENTION

In accordance with the present invention, a golf putter is provided which is extremely lightweight over the entire club except for heavy weights placed at the toe and heel portion of the club. The combination of the light frame structure and heavy toe and heel weighting provides a balanced club which is especially well suited for promoting a smooth and accurate putting stroke. In addition, the visual cues provided by the toe-heel weighting configuration promotes accurate striking of the ball with the club mid-portion.

The present invention is based upon a golf putter having a lightweight frame made of a composite material. The frame includes a vertical face plate for striking the golf ball and an integral horizontal hosel plate. Single metal weights are attached at the toe and heel ends of the face plate and hosel plate. The exterior surfaces of the toe and heel weights conform to and match the edges or perimeters of the face plate and hosel plate. The result is a golf putter having improved toe-heel balancing while at the same time providing enhanced visual cues for promoting a proper golf stroke.

As a feature of the present invention, the hosel is integrally attached at the mid-point of the hosel plate and is also made from a lightweight composite material matching the frame structure.

As another feature of the present invention, the heel weight of the putter is heavier than the toe weight to promote more accurate putter strokes. Further, the putter is face balanced so that the face plate remains vertical when the putter is suspended from the hosel or shaft attached thereto.

The above discussed and many other features and attendant advantages of the present invention will become better understood by reference to the following detailed description when take in conjunction with the accompanying drawings.

DETAILED DESCRIPTION OF THE PREFERRED EMBODIMENTS

Figure 2:
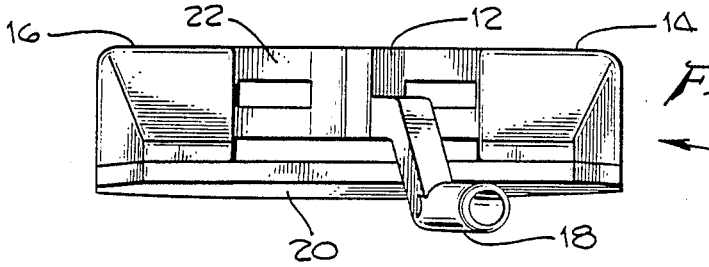
FIG. 2 is a top view of putter shown in FIG. 1.
Figure 4:
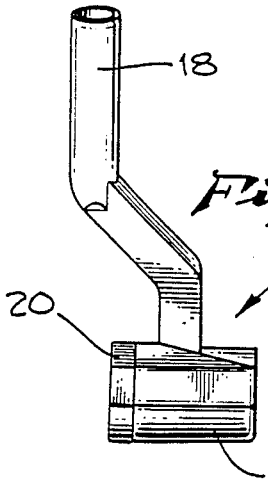
FIG. 4 is a left side view of the putter shown in FIG. 1.

A preferred exemplary putter is shown generally at 10 in FIGS. 1–10. The golf putter includes a lightweight frame 12, metal heel weight 14, metal toe weight 16 and hosel 18. The lightweight frame 12 includes a vertical face plate 20 and horizontal hosel plate 22.

The face plate 20, hosel plate 22 and hosel 18 are an integral structure made of lightweight composite material. The lightweight composite material used to form the structure can be any of the well known resin impregnated fiber materials which have been used in sporting equipment. Suitable resin impregnated fibers include graphite, boron, glass and ceramic. Any resin impregnated fiber combination may be used provided that it is lightweight and has sufficient strength. Conventional graphite fibers impregnated with epoxy resin or other suitable resin is preferred. Such resin impregnated graphite fibers are widely available in chopped fiber form and continuous fibers. It is preferred that continuous fibers impregnated with resin be used to ensure adequate structural strength. However, chopped fibers are also entirely adequate. The molding operations used to form the integral lightweight frame 12 and hosel 18 are well known and do not form part of the invention. Accordingly, the details of molding the lightweight frame 12 and integral hosel 18 will not be described.

Figure 1:
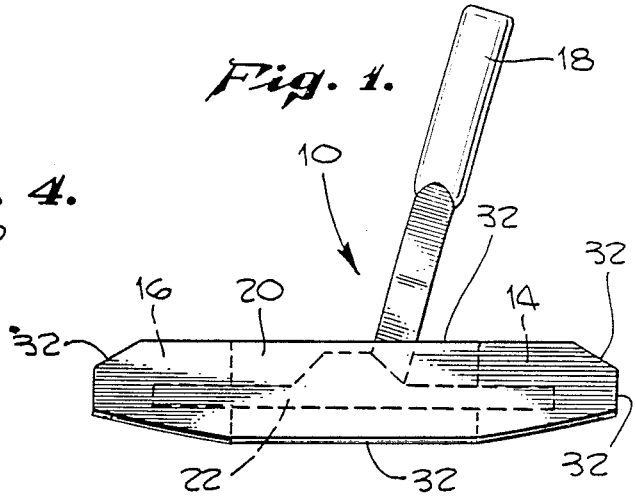
FIG. 1 is a front view of a preferred exemplary putter in accordance with the present invention.
Figure 5:
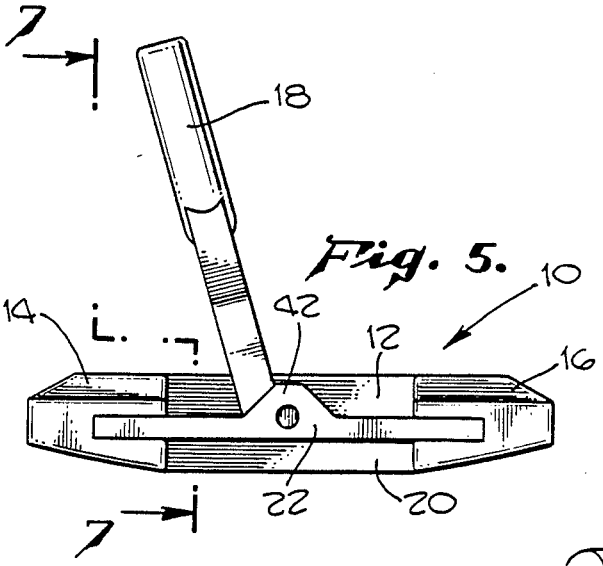
FIG. 5 is a back view of the putter shown in FIG. 1.
Figure 3:
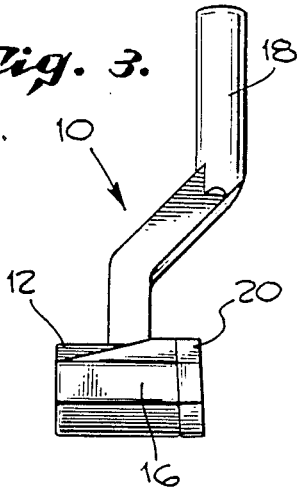
FIG. 3 is a right side view of the putter shown in FIG. 1.
Figure 6:
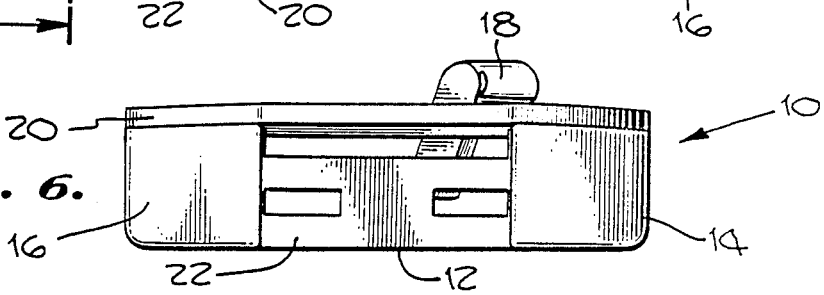
FIG. 6 is a bottom view of the putter shown in FIG. 1. p
Figures 7, 8, 9, 10:
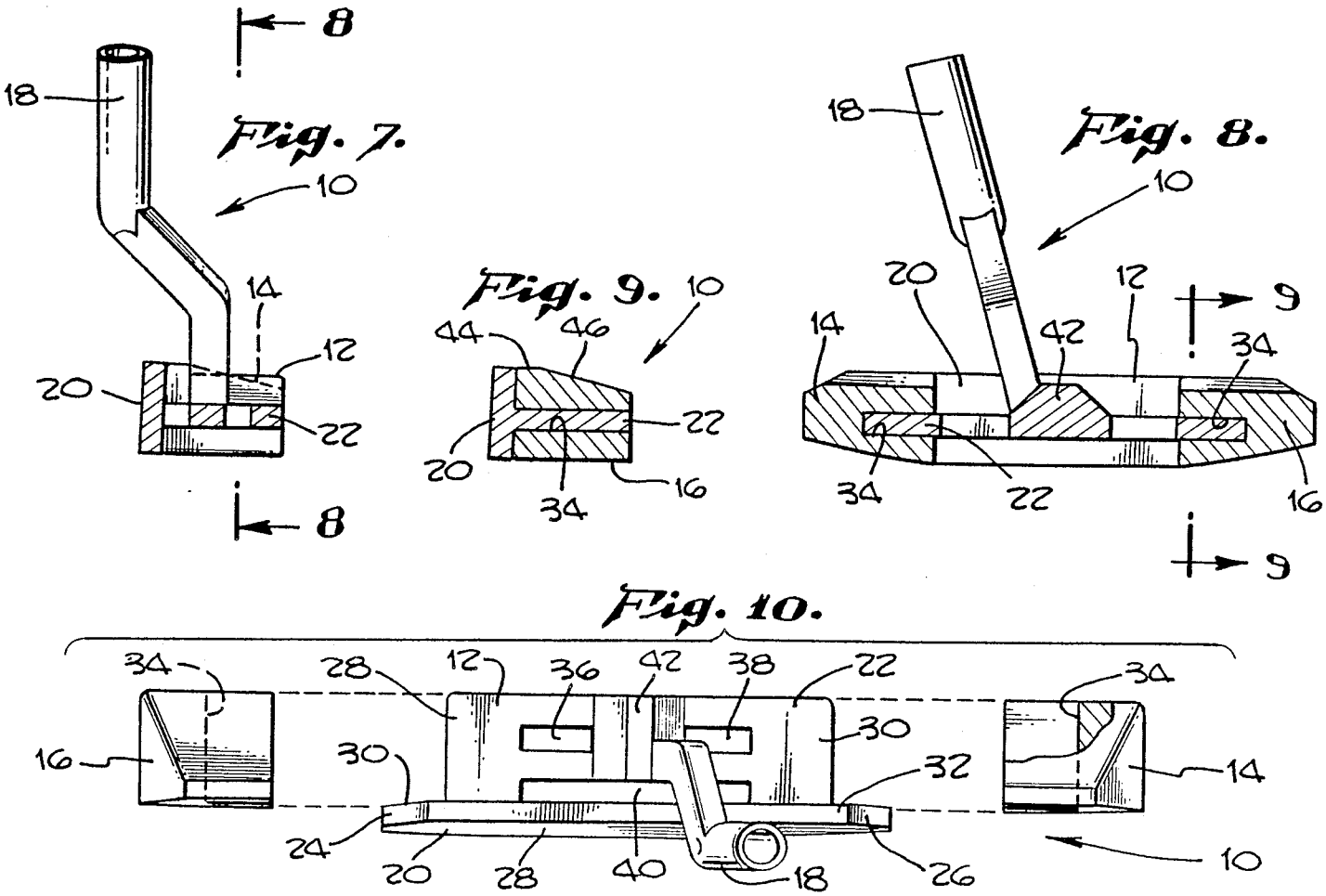
FIG. 7 is a side sectional view of FIG. 5 taken in the VII—VII plane.
FIG. 8 is a sectional view of FIG. 7 taken in the VIII—VIII plane.
FIG. 9 is a sectional view of FIG. 8 taken in the IX—IX plane.
FIG. 10 is a top-exploded view of the putter shown in FIG. 1.

Referring to FIG. 10 the face plate 20 includes a toe end 24 and a heel end 26. Likewise, the hosel plate 22 also has a toe end 28 and heel end 30. The face plate 20 also includes a front side 28, rear 30 and a perimeter or outer edge 32 which is best shown in FIG. 1. The exterior surfaces of the metal weights 14 and 16 are designed so that they match the perimeter 32 of face plate 20. As a result, the exterior surface of the heel and toe weights 14 and 16 form an exterior surface of the golf putter.

As best shown in FIGS. 8 and 9, the metal weights 14 and 16 include a channels or grooves 34 which allow the metal weights 14 and 16 to be matingly and securely attached to the hosel plate 22 and face plate 20. Preferably, the metal weights are glued or otherwise permanently bonded to both the hosel plate 22 and face plate 20.

The heel weight 14 and toe weight 16 are preferably made from a relatively heavy metal material. Suitable metal materials include steel, stainless steel, brass, alloys thereof and any other heavy metal which will provide adequate weighting of the club. Stainless steel is a preferred weighting material. It is preferred that the heel weight 14 be heavier than the toe weight 16. The amount of this weight increase may be varied to provide individualized balancing. Typically, the heel weight 14 will not be more than 10 percent heavier than toe weight 16. The combined total weight of heel weight 14 and toe weight 16 may be varied within conventional weight limits for putters to provide a golf putter having standard putter weight.

It is preferred to reduce the central weighting of the putter 10 as much as possible. Accordingly, the mid-portion of hosel plate 22 includes openings 36, 38 and 40. The openings reduce the central weight of the lightweight frame 12 even further. In addition, opening 40 is placed adjacent to face plate 20 in order to provide a resilient feel to the club when contact with the golf ball is made directly in front of opening 40. The hosel 18 is preferably integrally connected to hosel plate 22 via a reinforced structural area 42 which is located in the center of hosel plate 22 (see FIGS. 5, 8 and 10). Other connections between hosel 18 and hosel plate 22 are possible provided that they are sufficiently strong to withstand normal putter usage. It is preferred that hosel 18 extend upwardly from hosel plate 22 at the angle shown in FIGS. 1, 5 and 8. However, other hosel extension angles are possible if desired.

In addition to toe and heel weighting of the lightweight frame 12, it is preferred that the metal weights 14 and 16 be shaped so that the face plate 20 remains vertical when the club is suspended from the putter shaft (not shown) when the shaft is connected to hosel 18. This fore and aft weighting is accomplished by making toe and heel weights 14 and 16 thicker at the front of the club. As best shown in FIG. 9, the toe weight 16 is thicker at the front 44 than at the rear 46. It is preferred that the toe and heel weights 14 and 16 be sloped gradually from the thicker portion to the thinner portion in order to enhance visual cues provided to the golfer as he views the putter 10 from above.

The loft or vertical angle of face plate with respect to vertical may be varied within those ranges normally used for golf putters. Lofts ranging from zero degrees to a few degrees may be used if desired. In addition, the overall size and weight of the putter 10 may be within conventional limits.

The putter in accordance with the present invention incorporates a number of features which are designed to improve and enhance the golf putters stroke. Among these features includes the provision for maximum toe and heel weighting of a lightweight composite material frame to provide substantially all of the weight of the club at the toe and heel. The toe and heel weights are shaped so that their exterior surfaces conform to the perimeters of the lightweight frame structure so that the toe and heel weights actually form a major portion of the club exterior surface at the toe and heel location. Further, the metal weights are tapered towards the rear to provide a face balanced putter. In addition, a longitudinal opening is located behind the face plate and extends between the toe and heel weight to provide a resilient mid-portion of the face plate which provides a unique feel, sound and response when the golf ball contacts the face plate 22.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. A golf putter comprising:

a lightweight frame made of a composite material, said frame including a vertical face plate for striking a golf ball and an integral horizontal hosel plate, said hosel plate including a plurality of surfaces defining through openings in said hosel plate to reduce the weight of said frame, said face plate and said hosel plate each having a toe end and a heel end;

a metal toe weight attached at the toe ends of said face plate and said hosel plate, said toe weight having an exterior surface which forms an exterior surface of said golf putter and being shaped so that said face plate remains substantially vertical when said golf putter is suspended from a putter shaft;

a metal heel weight attached at the heel ends of said face plate and said hosel plate, said heel weight having an exterior surface which forms an exterior surface of said golf putter and being shaped so that said face plate remains substantially vertical when said golf putter is suspended from a putter shaft; and a hosel made from a composite material which is integral with said hosel plate and forms the connection between said golf putter end and a putter shaft.

2. A golf putter according to claim 1 wherein said face plate includes a front side, a rear side and a perimeter and wherein said toe weight and heel weight exterior surfaces have perimeters which match with the perimeter of said face plate.

3. A golf putter according to claim 1 wherein said hosel plate includes a front portion integrally connected to the rear side of said face plate and a rear portion terminating in a rear edge wherein said toe weight and heel weight exterior surfaces have perimeters which match with the rear edge of said hosel plate.

4. A golf putter according to claim 1 wherein said heel weight is heavier than said toe weight.

5. A golf putter according to claim 1 wherein said hosel extends vertically from a midpoint between the toe end and heel end of said hosel plate.

6. A golf putter according to claim 1 wherein said toe and heel weights each includes a mounting channel of sufficient size to matingly fit over the respective toe and heel ends of said hosel plate.

7. A golf putter according to claim 1 wherein said metal heel and toe weights are made from stainless steel.

8. A golf putter according to claim 1 wherein said composite material comprises resin impregnated graphite fibers.

9. A golf putter according to claim 1 wherein at least one of said openings is adjacent to said face plate.

* * * * *